United States Patent [19]

Calder

[11] Patent Number: 4,830,281

[45] Date of Patent: May 16, 1989

[54] SPRAY TIP WITH SEAL EJECTOR

[75] Inventor: Oliver J. Calder, Orange, Calif.

[73] Assignee: ASM Corporation, Orange, Calif.

[21] Appl. No.: 138,286

[22] Filed: Dec. 28, 1987

Related U.S. Application Data

[63] Continuation-in-part of Ser. No. 766,190, Aug. 16, 1985, Pat. No. 4,715,537.

[51] Int. Cl.[4] ..... B05B 15/02

[52] U.S. Cl. ..... 239/119; 137/329.01; 239/288.3; 239/391; 239/600; 251/362; 251/363

[58] Field of Search ..... 239/119, 288, 288.3, 239/288.5, 390, 391, 392, 114, 123, 600; 137/329.01; 251/360, 362, 363

[56] References Cited

U.S. PATENT DOCUMENTS

| | | | |
|---|---|---|---|
| 4,116,386 | 9/1978 | Calder | 239/119 |
| 4,165,836 | 8/1979 | Eull | 239/288 |
| 4,483,481 | 11/1984 | Calder | 239/600 |
| 4,484,707 | 11/1984 | Calder | 239/288.3 |
| 4,508,268 | 4/1985 | Geberth, Jr. | 239/119 |
| 4,635,850 | 1/1987 | Leisi | 239/391 |
| 4,715,537 | 12/1987 | Calder | 239/119 |

*Primary Examiner*—Andres Kashnikow
*Assistant Examiner*—Michael J. Forman
*Attorney, Agent, or Firm*—Plante Strauss Vanderburgh

[57] ABSTRACT

There is disclosed a spray tip useful for high pressure, airless spraying which has an orifice tip holder that is reversible between spraying and cleaning positions and that is interchangeable with other holders supporting orifice tips of varied diameters and capacities. The invention particularly provides a turret member as the orifice tip holder which has a size that permits it to be used as an ejector pin or member for removal of the seal from the spray tip. The turret member is sealed in the assembly by a floating seal in which the liquid line pressure provides the force to maintain the seal against the cylindrical member. The forward end of the floating seal has a seal face formed of a very hard, preferably reinforced plastic.

24 Claims, 3 Drawing Sheets

SPRAY TIP WITH SEAL EJECTOR

REFERENCE TO RELATED APPLICATIONS

This application is a continuation in part of Ser. No. 766,190, filed Aug. 16, 1985, now U.S. Pat. No. 4,715,537, issued Dec. 29, 1987.

BACKGROUND OF THE INVENTION

This invention relates to a spray tip for airless spraying, and, in particular, to a reversible and interchangeable spray tip holder which can be used as a seal ejector.

BRIEF STATEMENT OF THE PRIOR ART.

In my prior U.S. Pat. No. 3,831,862, I have disclosed a spray tip assembly in which the spray tip orifice is mounted in a removable and reversible sleeve which is secured in the housing with a sliding pin interlock that seats against a spring biased seal. This construction requires loosening of the body from its adapter to reverse and/or replace the spray tip orifice.

In my prior U.S. Pat. No. 4,116,386, I disclosed a spray tip assembly in which the spray tip orifice is mounted in a cylindrical turret member which can be rotated in the housing to reverse the orifice member for cleaning. This construction employs a solid, resilient plastic seal which has a concave, cylindrical sealing surface. The plastics used for this seal tended to seize the turret member and required use of a wrench to rotate the turret member. U.S. Pat. No. 3,202,360 also discloses an airless spray tip having a rotatable turret member, which is sealed with a packing sleeve and nut.

In my prior U.S. Pat. No. 4,484,707 I disclose that difficulties experienced in interchanging turret members can be avoided if the turret seal is indexed against rotation and retained against dislodgement when the turret member is removed. A similar construction is disclosed in U.S. Pat. No. 4,508,268.

A wide variety of materials have been suggested for the turret seal, with varying results. U.S. Pat. No. 4,165,836 suggests use of a metal seal. U.S. Pat. No. 4,508,268 suggests the use of hard steel, tungsten carbide, or ceramics. Seals formed of these very hard materials, however, do not seal adequately with low viscosity liquids or when used at very high liquid pressures. Additionally, the metal seals have a high coefficient of friction, and when the orifice becomes clogged, a wrench must be used to rotate the turret to reverse the position of the orifice and clear the obstruction from the orifice.

In my prior U.S. Pat. No. 4,483,481, I have disclosed that the turret member can be sealed effectively against low viscosity liquids and at high pressures without seizure by using a very thin plastic seal on a metal seal support.

In my recently issued U.S. Pat. No. 4,715,537, I disclose an entirely plastic seal for a reversible and removable turret member. While this seal is very effective, its removal for replacement or servicing requires use of a probe or supplemental tool.

In a typical spray application, it is frequently necessary to substitute or replace the seals which engage against the turret member. The seals and seal supports are usually retained within the spray tip housing when the turret members are removed and a separate tool must be provided to eject the seals. It is desirable that the spray tip permit a simple removal and interchanging of the spray tip seal without use of a separate tool which is usually misplaced or lost by the operator.

BRIEF STATEMENT OF THE INVENTION

This invention comprises a spray tip useful for high pressure, airless spraying which has an orifice tip holder that is reversible between spraying and cleaning positions and that is interchangeable with other holders supporting orifice tips of varied diameters and capacities. The invention particularly provides a turret member as the orifice tip holder which has a size that permits it to be used as an ejector pin or member for removal of the seal from the spray tip. The turret member is sealed in the assembly by a floating seal in which the liquid line pressure provides the force to maintain the seal against the cylindrical member. The forward end of the floating seal has a seal face formed of a reinforced plastic. A very hard plastic such as an acetal copolymer is used and, preferably, this plastic is reinforced with glass fibers.

In further detail, the spray tip of the invention has a tubular housing with a longitudinal through passageway and an intersecting, orthogonal bore in which the cylindrical turret member is removably and rotatably mounted. The turret member has a transverse passageway in which is seated an orifice member formed of tungsten carbide. The floating seal is received in the longitudinal through passageway of the housing, and is sealed therein with an annular resilient seal, preferably with an elastic O-ring. A compression spring can be used to supplement the liquid line pressure in compressing the turret seal.

The housing is formed as a subassembly with a plastic spray guard having an internal cavity which receives the tubular housing. The spray guard has a slotted aperture to receive the turret member handle which as a radial prong that is received through the slotted aperture, thereby securing the assembly of the housing and turret member. The spray gun has internally molded shoulders which serve as rotational stops for the turret member handle, thus aligning the orifice tip with the through passageway of the housing in its spraying and cleaning positions. The spray tip is secured to the end of a spray gun with a retainer nut that engages a retaining flange carried by the housing adapter.

The spray tip of this invention provides very superior performance over all other spray tips. Even though the floating seal is compressively secured in the housing, it can be easily ejected by inserting the turret member through the discharge end of the housing. The turret member can be readily rotated and removed by hand without a wrench or pliers, even when the orifice tip is clogged with an obstruction. It is thus the first "tool-free" spray tip that has ever been designed for airless liquid spraying.

The floating plastic seal is very effective, even with very low viscosity liquids and seals the turret member against leakage even at extremely high pressures. Even at very high liquid pressures, the turret member can be freely rotated between its spraying and cleaning positions. The annular resilient seal on the floating seal permits the necessary axial movement of this member, while preventing dislodgement of the member when the turret member is removed or replaced.

BRIEF DESCRIPTION OF THE DRAWINGS

The invention will be described with reference to the FIGURES, of which.

DESCRIPTION OF THE PREFERRED EMBODIMENTS

Figure 1:
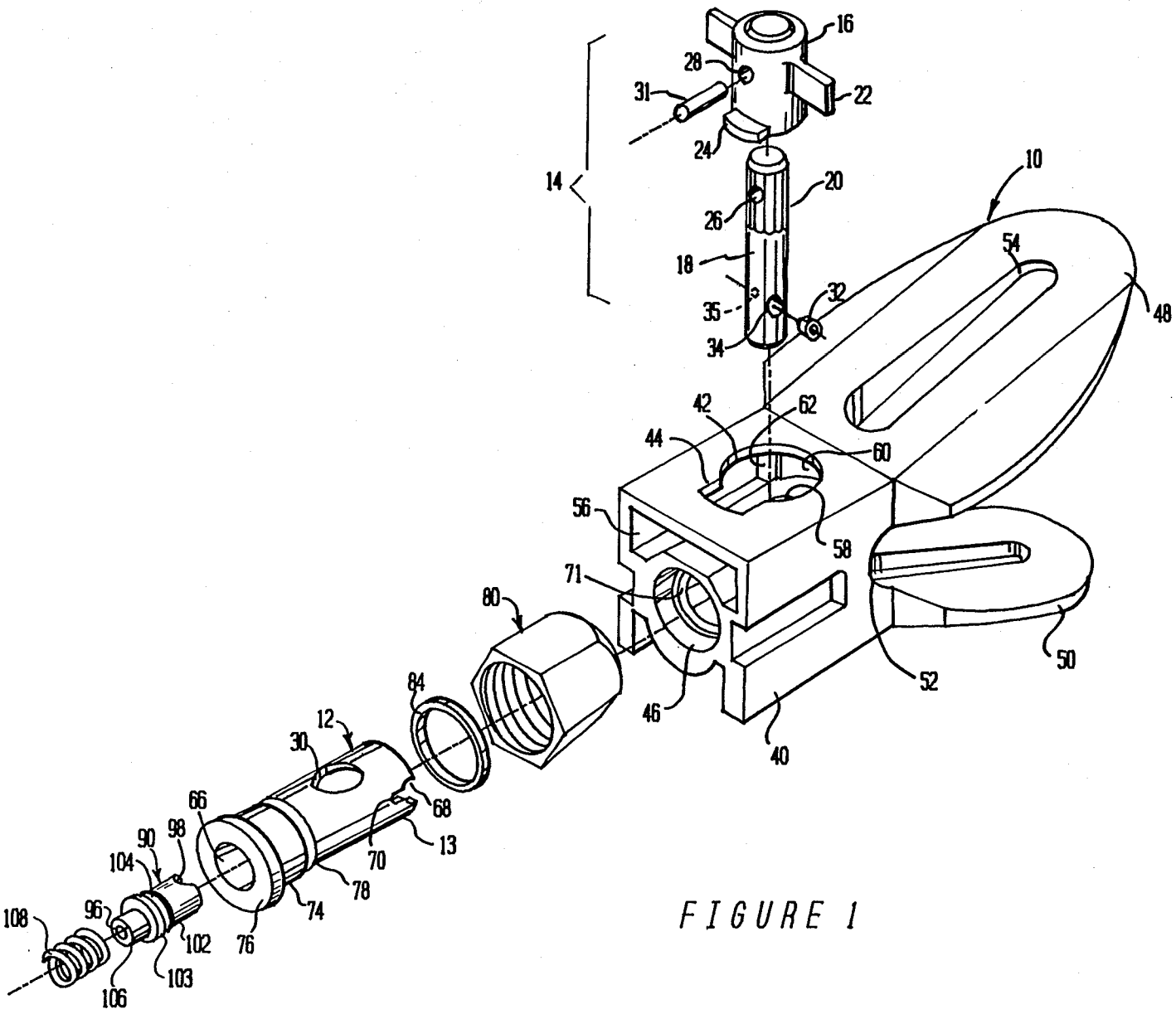
FIG. 1 is an exploded perspective view of the spray tip of the invention.

Referring now to FIG. 1, the invention is shown with a spray guard 10 which mounts on a tubular housing 12 that supports a turret member subassembly 14. The turret member subassembly 14 is formed of a handle 16 which is dependent from cylindrical turret member 18. The upper end 20 of turret member 18 preferably is splined, as illustrated, and is press-fitted into a central bore in the underside of handle 16. The handle 16 has a pair of ears 22, and a radial prong 24 at its base. The turret member is indexed to a precise position in handle 16 by alignment of transverse bore 26 in its upper end 20 with mating bore 28 in the handle, and a roll pin 30 can be used to complete the assembly.

The turret member 18 carries a spray tip orifice member 32 in a transverse bore 34. Bore 34 is counterbored with a small diameter through bore 35. The spray tip orifice member 32 is firmly seated within bore 34 sufficiently that the orifice tip 32 does not project beyond the cylindrical surface of turret member 18.

The spray guard 10 has a body 40 with an aperture 42 to receive the base of handle 16. The turret member assembly 14 has a radial prong 24 and aperture 42 has a notch 44 which permits passage of the handle when the latter is rotated to align prong 24 with notch 44.

The spray guard 10 has a central longitudinal, cylindrical cavity 46 that receives the tubular body 13 of the housing 12. At its forward end, the spray guard 10 has a pair of outwardly diverging wings 48 and 50 which are generally trapezoidal. At the apex or intersection of wings 48 and 50, the spray guard has a slot 52 to provide clearance for the spray discharged from the spray tip. Each of the outwardly diverging wings 48 and 50 has a longitudinal, central, through slot such as 54. As illustrated for the preferred embodiment, the slots are narrow and extend substantially the entire length of wings 48 and 50.

The spray guard body 40 also has an internal cavity 56 superimposed over cavity 46 and this cavity has a central bore 58 to receive the turret member 18. The end interior wall 60 of cavity 56 has internal shoulders such as 62, which are spaced at opposite sides of the cavity 56. These shoulders serve as limiting stops for the rotation of the turret member, engaging prong 24 and permitting rotation of the turret member through only 180 degrees of rotation. These rotation-limiting stops are engaged when the turret member is in either its cleaning or spraying positions, with its transverse bore 34 in alignment with the longitudinal through passageway of the spray tip.

The tubular housing 12 has a longitudinal through passageway 66, and a cylindrical bore 30 orthogonal to and intersecting the longitudinal through passageway 66 and this cylindrical bore 30 receives the cylindrical turret member 18. At its forward end, the housing 12 has an arcuate slot 68 at each side, which has a smaller, longitudinal extension slot 70. The arcuate slot 68 aligns with the slot 52 in the spray guard body 40 and provides clearance for the liquid spray from the orifice 32. The extension slots 70 receive keys (not shown) on the internal sidewalls of the cavity 46 in the spray guard body 40, thereby keying the spray guard to the housing 12. At its upstream end 74, housing 12 has an annular flange 76, and an annular groove 78. The annular groove 78 receives a detenting rib 71 which is molded on the inside wall of the spray guard 12, thereby firmly securing the assembly of housing 12 and spray guard 10.

The spray tip assembly is retained on the externally threaded barrel of the spray gun by the retainer cap nut 80 which is received over the housing 12. The annular end flange 76 is received within the retainer nut 80, and a low frictional characteristic, bearing washer 84 is captured between the annular flange 76 and the retainer not 80. This washer provides very low frictional resistance between the retainer nut and the housing 12 when the retainer nut 80 is tightened. The central through passageway of the housing body 12 receives the floating seal 90.

The floating piston seal 90 comprises a sleeve body 94 with a through bore 96. At its forward end the sleeve body 94 carries turret seal 98. The seal 98 has a cylindrically concave face, to mate with the cylindrical contour of turret member 18. Sleeve body 94 has an annular groove 102 which receives an annular resilient sealing member, preferably an O-ring 104 to seal the floating piston in the longitudinal through passageway of housing 12. The upstream end of sleeve body 94 has an annular rim 103 and a reduced diameter neck 106. A compression spring 108 is received over neck 106.

Figure 2:
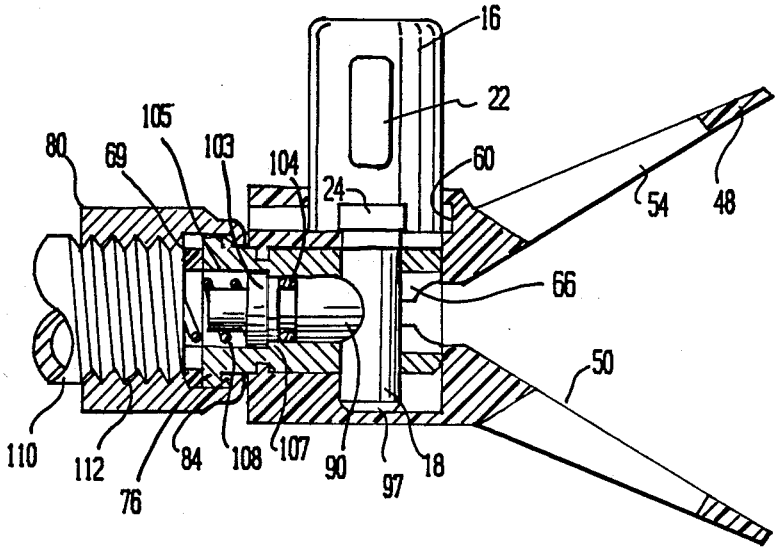
FIG. 2 is an elevational sectional view of the spray tip of the invention.

FIG. 2 illustrates the spray tip assembled to a spray gun 110 by the retainer cap nut 80 which is threaded onto the externally threaded barrel 112 of the spray gun. Compression spring 108 bears against the end of the spray gun barrel and applies a resilient force to the floating seal 90. Preferably, a low frictional seal washer 69 is positioned between the face of flange 76 of housing 12 and the end of the spray gun, and this washer cooperates with washer 84 to insure the free rotation of the housing on the end of the spray gun. Suitable materials for these washers are Teflon and Nylon. The washers provide very low frictional drag resisting the turning of the spray tip when it is assembled onto the end of a spray gun, thereby permitting rotation of the spray tip to change the position of the spray pattern without loosening of the retainer nut 80 which secures the spray tip to the spray gun.

The housing through passageway 66 is formed with a large diameter counterbore 105 at its upstream end 74 to form an annular shoulder 107 and annular rim 103 abuts against this shoulder, limiting the forward axial travel of the floating seal within through passageway 66.

Figure 3:
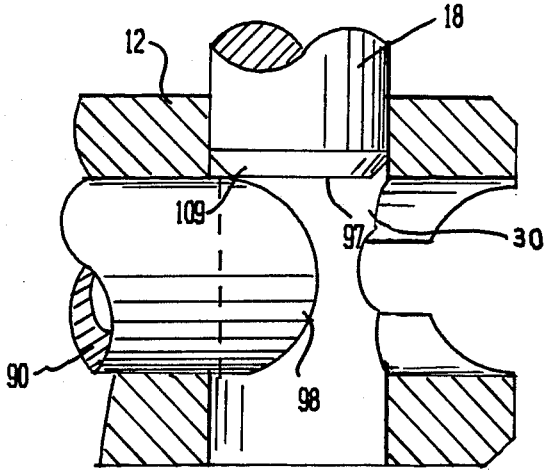
FIG. 3 is an exploded perspective view of the turret and housing of the spray tip.

FIG. 3 illustrates the positions of the turret seal 98 and the turret 18 during removal and replacement of the turret member. As illustrated, the turret member 18 is being inserted into the cylindrical bore 30. In this operation, the retainer cap nut has not been loosened and spring 108 exerts an axial force on the floating seal biasing it in a downstream direction. The shoulder 107 (shown in FIG. 2) limits the forward travel of the floating seal when it has entered the cylindrical bore 30 a very slight distance, typically from 0.05 to 0.15 inch, less than the amount of the bevelled offset 109 on the lower end 97 of the turret member 18. For this purpose, the distance from the annular shoulder 107 to the perimeter of the cylindrical bore 30 is approximately 0.05 to 0.15 inch less than the length from the coacting annular rim 103 to the cylindrically concave face 98 of the seal, to permit the seal 98 to enter into the cylindrical bore 30 by this distance when the turret member 14 is removed from the cylindrical bore 30. This insures that the seal will always be pressed against the turret member 18.

The lower end 97 of the turret member 18 has a bevel 109 which is at an angle of at least 60 degrees to its end face to permit it to be inserted into the cylindrical bore 30 past the projecting end of said seal.

The floating seal is an extremely effective dynamic seal for the turret member. The turret member is freely rotatable even at fluid pressures up to about 5000 psi., and the seal is effective even with very low viscosity liquids, even at pressures which are sufficient to actually cause physical damage to the seal, e.g., pressures of about 7500 psi. The floating seal is compressed against the turret member by the line pressure which is applied against the upstream face of the piston, and the resultant force is sufficient to seal its cylindrically concave face against the turret member. The effectiveness of the piston seal is quite surprising in that the sealing face of the piston which is applied against the turret member has a greater surface area than the upstream face of the piston. The line pressure which is applied against the upstream, face is nevertheless sufficient to force the piston sealing face against the turret member to prevent leaking of the fluid, even when there is no flow through the orifice tip, e.g., when the orifice tip becomes clogged. The spring 108 is preferably used in the assembly as it provides an initial seating of the piston seal face against the turret member. Without the spring, a slight leaking or spurting of liquid from the spray tip occurs when the line pressure is first applied, until the line pressure is effective to move the floating piston seal securely against the turret member. The use of the spring 108 avoids even this slight leaking.

The floating piston seal is formed entirely of plastic, which is filled with from 5 to 50, preferably from 15 to about 30, weight percent of a reinforement filler. Various plastics can be used for this purpose, including acetal homopolymer and copolymer, polysulfones, polyphenylene sulfide, polycarbonate, thermosetting and thermoplastic polyimides, Nylon, poly(amide-imide), etc. Acetal copolymer is preferred for its hardness and wear resistance. The acetal copolymer is prepared by the copolymerization of trioxane with slight amounts of a comonomer which provides carbon to carbon bonding in the polymer chain, thereby imparting a high degree of thermal stability to the polymer. The polymer has a very high creep resistance and a tensile strength in excess of 15,000 psi.

The fillers which can be used for reinforcement of the plastic seal body include graphite, silica, alumina powders, and fibrous reinforcements such as graphite and glass fiber. Preferably, glass fibers having lengths from about 0.05 to about 0.25 inch are used.

The spray tip of this invention is provided with a plurality of interchangeable turret members with varied sizes of orifice tips to permit the user to switch turret member whenever it is desired to change the volume or spread of the fan spray. The orifice tips can be provided in sizes from about 0.005 to about 0.075 inch in any varied increments, preferably in increments from about 0.001 to 0.003 inch. These orifice tips will provide a fan spray with a width from 2 to about 22 inches in approximately 2 inch increments.

The resilient annular seal means about the floating piston seal prevents any leakage of fluid past the piston and through the housing 12. It also restrains the piston seal 90 in the housing 12 against dislodgement or rotation when the turret member 18 is removed or replaced, thereby ensuring that the turret member, or a replacement turret member, can be quickly inserted without need to reposition the seal support.

The invention provides a number of definite advantages over prior spray tips. The plastic seal of the invention tightly seals and prevents leakage even with low viscosity liquids. The turret member can be quickly reversed to its clean-out position, any obstructions can be sprayed out of the orifice, and the turret member can be returned to its spraying position, all without loosening the retainer nut. The turret member is easily removable from the spray tip simply by loosening retainer cap nut 80 and rotating the turret member handle 16 to align its prong 24 with the notch 44 of the spray guard. When the turret member is removed, the floating piston seal remains in place to permit rapid replacement of the turret member. The retainer cap nut can be tightened and loosened by hand and the spray tip can be rotated on the spray gun without loosening the cap nut. At very high pressures, the cap nut can be tightened with a wrench, with or without the low frictional washer 69 and complete sealing is achieved even up to pressures which are sufficient to destroy the internal seals of the tip, and throughout this pressure range, the turret is freely moveable between its spraying and cleaning positions.

Figure 4:
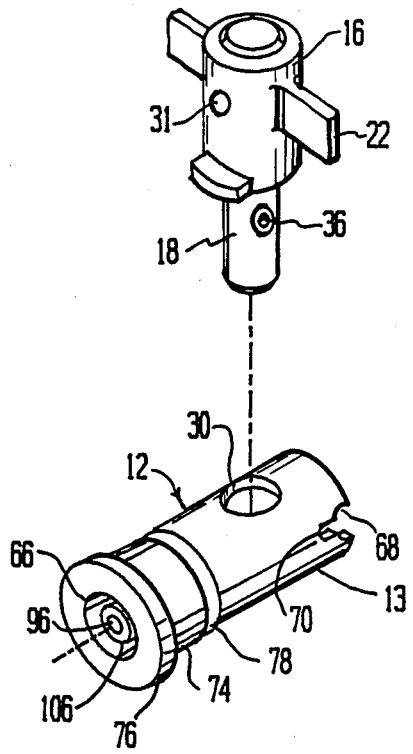
FIG. 4 illustrates removal of the turret member from the spray tip housing.
Figure 5:
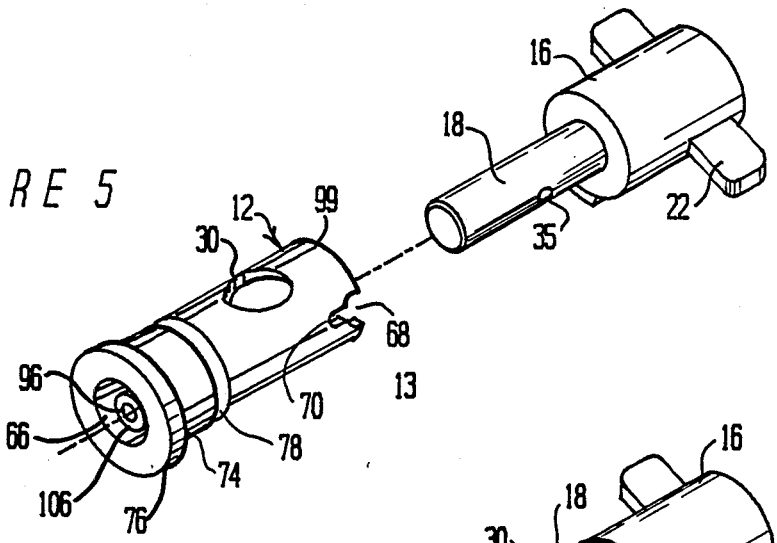
FIG. 5 illustrates positioning of the turret member for use in ejecting the seal.
Figure 6:
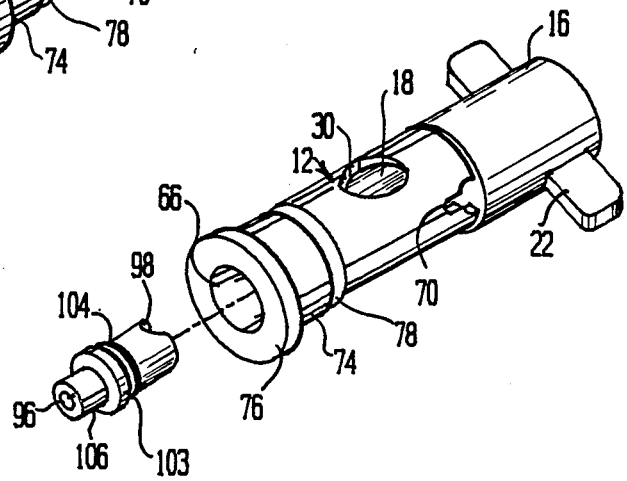
FIG. 6 illustrates insertion of the turret member into the discharge end of the housing to eject the floating seal.

FIGS. 4–6 illustrate the use of the turret member subassembly 14 to eject the floating seal. In this operation, the spray tip is removed from the spray gun, and the floating seal is ejected out of the upstream end of the housing 12. The spray guard 10 is not shown in FIGS. 4–6 for illustration purposes only, as it need not be removed from the housing in order to eject the floating seal. FIG. 4 illustrates the first step, removal of the turret member 18, which is removed with the floating seal remaining in the housing 12 with its reduced diameter neck 106 visible in through passageway 66 of housing 12.

The turret member is then rotated and positioned opposite the open discharge end 99 of housing 12 and is advanced into the through passageway 66. For this purpose, the turret member 18 should have a diameter slightly less than the internal diameter of passageway 66, to permit its insertion into the passageway 66 without any interference or hindrance. The length of the turret member 18 is also sufficient that its lower end 97 contacts the forward face of floating seal 90 and forces the floating seal 90 from the housing as it is advanced into passageway 66, all as shown in FIG. 6. The floating seal 90 can then be replaced with a new seal, and the spray tip can be reassembled onto the spray gun to resume spraying.

The invention has been described with reference to the illustrated and presently preferred embodiment. It is not intended that the invention be unduly limited by this disclosure of the presently preferred embodiment. Instead, it is intended that the invention be defined by the means, and their obvious equivalents, set forth in the following claims.

I claim:

1. A spray tip comprising:

a. a body subassembly comprising a housing having a longitudinal through passageway extending from an inlet passage to an open discharge end, an intersecting orthogonal cylindrical bore, and adapter means attached to its end having said inlet passage for attachment of said body subassembly to a spray gun;

b. a cylindrical turret member having a distal portion removably and rotatably seated in said intersecting orthogonal cylindrical bore of said housing, and having a transverse bore rotatable into alignment with said through passageway; and c. a spray tip orifice member mounted in said orthogonal cylindrical bore of said turret member; and d. a seal member axially having a seal through passageway and slidably received in said through passageway of said housing and being freely slidable into and out of said through passageway of said housing through said inlet passage thereof and including a turret member seal having a cylindrical concave seal surface facing said turret member; and with the diameter of said distal portion of said turret member having a diameter less than the diameter of said open end of said housing whereby said distal portion of said turret member can be inserted into the open end of said housing to abut said seal member and eject said seal member through said inlet passage.

2. The spray tip of claim 1 wherein the inlet passage of said through passageway is of greater diameter than its discharge end, thereby providing an annular shoulder between the inlet passage and said intersecting bore and said seal has a coacting annular rim of greater diameter whereby said annular shoulder serves as a stop limiting the axial movement of said seal through said through passageway of said housing.

3. The spray tip of claim 2 wherein the distance from said annular shoulder to the perimeter of said cylindrical bore is approximately 0.05 to 0.15 inch less than the length from said coacting annular rim to the cylindrically concave face of said seal, to permit said seal to enter into said cylindrical bore by said distance when said turret member is removed from said cylindrical bore.

4. The spray tip of claim 3 wherein the lower end of said turret member is beveled at an angle of at least 60 degrees to its end face to permit it to be inserted into said orthogonal cylindrical bore past said seal.

5. The spray tip of claim 2 wherein said turret member has a lesser diameter than said annular shoulder whereby it can be inserted into said through passageway and past said annular shoulder.

6. The spray tip of claim 1 wherein said seal includes a piston portion received in said inlet passage.

7. The spray tip of claim 6 including annular seal means received about said piston portion of said seal and engaging the inside walls of said through passage to effect fluid sealing of said piston portion of said seal against said line pressure within said passage.

8. The spray tip of claim 7 wherein said seal is an acetal plastic.

9. The spray tip of claim 1 including resilient means positioned to bias said seal against said turret member.

10. The spray tip of claim 1 wherein said seal is a hard plastic.

11. The spray tip of claim 1 wherein said seal is a fiber reinforced plastic.

12. A combination of a spray gun having a discharge barrel with an externally threaded discharge end and a spray tip received thereon and comprising:

a. a spray tip subassembly including an outer, annular flange and an inlet passage on one end and a housing with an open discharge end opposite said one end and having a longitudinal chamber and an intersecting orthogonal cylindrical bore;

b. a cylindrical turret member removably and rotatably seated in said intersecting orthogonal cylindrical bore of said housing, and having a transverse bore rotatable into alignment with said through passageway and a diameter less than the diameter of said open end of said housing whereby said turret member can also be inserted into the open end of said housing;

c. a spray tip orific member mounted in said transverse bore; and d. a single seal subassembly axially slidably received in said longitudinal chamber and comprising:

(i) a turret member seal formed of a hard, reinforced plastic received in said longitudinal chamber and having a rear face facing said inlet passage and a cylindrical concave seal surface facing said turret member with a central through passageway therebetween; and (ii) resilient means captured between said seal and the end of the barrel of said spray gun to bias said seal against said turret member; and e. a retainer nut received over said outer flange of said housing and threadably engaged onto said externally threaded end of said spray gun discharge barrel.

13. The combination of claim 12 wherein said resilient means is a compression spring captured between said piston and said spray gun discharge barrel.

14. The combination of claim 12 including a piston portion of said seal received in said central inlet passage.

15. The spray tip of claim 12 wherein said longitudinal chamber has a shoulder on its inner wall, intermediate its length, and said seal has a coacting annular rim of greater diameter whereby said shoulder serves as a stop limiting the axial movement of said seal through said longitudinal chamber of said housing.

16. The spray tip of claim 15 wherein said turret member has a diameter sufficiently small to permit it to be inserted into said longitudinal chamber, past said shoulder, and thereby serve to eject said seal from said housing.

17. The spray tip of claim 16 including annular seal means received about said piston portion and engaging the inside walls of said longitudinal chamber to effect fluid sealing of said piston portion against said line pressure within said chamber.

18. In a spray tip for the pressured spraying of liquids having a spray tip body with a through passageway with an inlet end to receive liquid under pressure and an outlet end to discharge liquid, and a receptacle which intersects said through passageway having at least one open end with a holder rotatably received in said open end of said receptacle and supporting a spray orifice within said through passage, and a seal slidably received within said through passageway and freely slidable into and out of said through passageway through said inlet end thereof and located between said inlet end of said body and said holder and having a sealing face which is compressed against said holder, the improvement which comprises: providing said holder with a lesser diameter than said passageway and said seal, whereby said holder may be removed from its receptacle and inserted through said discharge end of said through passageway to eject said seal from the inlet end of said through passageway.

19. The spray tip of claim 18 wherein said seal includes a piston portion received in said through passageway.

20. The spray tip of claim 18 including annular seal means received about said seal piston and engaging the inside walls of said through passageway to effect fluid sealing of said piston against said line pressure within said passageway.

21. the spray tip of claim I8 including resilient means positioned to bias said seal against said turret member.

22. The spray tip of claim 18 wherein said seal is a hard plastic.

23. The spray tip of claim 18 wherein said seal is a fiber reinforced plastic.

24. The spray tip of claim 23 wherein said seal is an acetal plastic.

* * * * *